United States Patent [19]

Marsalis

[11] Patent Number: 4,621,621

[45] Date of Patent: Nov. 11, 1986

[54] VACUUM VALVE SYSTEM

[76] Inventor: John P. Marsalis, 19735 Michaels St., Castro Valley, Calif. 94546

[21] Appl. No.: 702,981

[22] Filed: Feb. 19, 1985

[51] Int. Cl.[4] ..... A61H 31/02

[52] U.S. Cl. ..... 128/30.2; 128/202.12; 128/205.24; 128/205.26; 137/624.17; 137/625.45; 137/874; 137/875

[58] Field of Search ..... 128/30, 30.2, 202.12, 128/205.26, 205.24, 204.25, 910, 25 R; 137/624.17, 625.2, 625.44, 625.45, 874, 875; 74/568 R, 124, 125.5

[56] References Cited

U.S. PATENT DOCUMENTS

| | | | |
|---|---|---|---|
| 2,707,948 | 5/1955 | Emerson | 128/30.2 |
| 3,132,669 | 5/1964 | Feldsted | 137/874 |
| 3,269,388 | 8/1966 | Glascock et al. | 128/30 |
| 3,312,114 | 4/1967 | Chuchla | 137/624.17 |
| 3,331,254 | 7/1967 | Stoll | 74/568 |
| 3,372,708 | 3/1968 | Hotchkin | 74/568 |
| 4,442,865 | 4/1984 | Shigeo | 137/874 |
| 4,469,135 | 9/1984 | Gray | 137/874 |

OTHER PUBLICATIONS

J. H. Emerson Company, 33-CRS, "Emerson Chest Respirator", Cambridge, Mass.

Monaghan, a Div. of Sandoz Inc., 170C Respirator, "Operator and Maintenance Manual".

J. H. Emerson Company, "Emerson Chest Respirator", Cambridge, Mass. 1/1974.

J. H. Emerson Company, "Emerson Chest Respirator", Cambridge, Mass. 1/1974.

J. H. Emerson Company, "Emerson Birtheez", Cambridge, Mass.

*Primary Examiner*—Henry J. Recla

*Attorney, Agent, or Firm*—Manfred M. Warren; Robert B. Chickering; Glen R. Grunewald

[57] ABSTRACT

Disclosed is an inventive valve assembly (24) for coupling a respirator jacket (26) to a household vacuum cleaner (28). The respirator jacket is used to assist a human user (22) in breathing. One embodiment includes a fixed first conduit (48) and an oscillating second conduit (44) which moves on a rocker arm (62) into and out of fluid communicating position with the first conduit. A cam assembly (72) having two arcuate cam surfaces (A1, B1) is adjustable to vary the duration during which the conduits are in fluid communication. Also adjustable is the frequency of oscillation of the second conduit. The duration and frequency are independently adjustable. Reference numerals used in this Abstract highlight the Detailed Description and Drawings, and do not limit the scope of the invention, which is much more broadly defined by the claims.

4 Claims, 11 Drawing Figures

VACUUM VALVE SYSTEM

BACKGROUND OF THE INVENTION

The field of this invention relates generally to vacuum valve systems, and more particularly to vacuum valve systems used between a vacuum source and a respirator breathing jacket to help control breathing by a human user.

Vacuum valve systems are now in use for operating breathing jackets. An example of a vacuum valve breathing system is the Emerson Chest Respirator consisting of a model 33-CRS chest respirator pump with hose, a body wrap, a support grid, and a backplate, manufactured by the J. H. Emerson Company of Cambridge, Mass. Another example of a commercially available system is the Monaghan 170 C Respirator which also includes a shell for wrapping around a human user, manufactured by Monaghan, A Division of Sandoz, Inc.

Both of these systems are similar in construction and operation. An airtight jacket encloses, in spaced apart relation, at least a part of the torso of the user. The jacket is coupled through a hose to a pump which is controllable through dials and switches by the user or an operator. With these controls, the operator can (1) vary the frequency of inspiration and expiration, that is, the breathing rate or how fast the user breathes, and (2) vary the duration of each inspiration and expiration, that is, determine how deep or shallow each breath will be.

Expensive and technically complex control systems are now in use to control frequency and duration of breathing, but even with such sophisticated controls, multiple adjustments are necessary to finally obtain an optimum mix of breathing frequency and duration. Such control systems and the apparatus which they control are constructed so that adjustment of either the frequency or the duration of breathing affects the other. Thus, frequency variations produce duration variations, and adjustments to the duration produce changes in the breathing frequency. Reaching the optimum frequency and duration, therefore, often requires multiple adjustments by even highly skilled personnel.

SUMMARY OF THE INVENTION

This invention provides an improved vacuum valve system for controlling flow of a fluid such as ambient air.

The invention includes a valve apparatus having a first conduit for passing a fluid, a second conduit for passing a fluid, and means for translating the conduits (1) into fluid communication with each other in an aligned position, and (2) substantially out of fluid communication with each other in a displaced position.

Mechanical means are provided for periodically translating the conduits into and out of fluid communication with respect to each other. The translating means is adjustable to vary the frequency of translation, and therefore the breathing rate or the breaths per minute, and also is adjustable to vary the duration or fluid communication in the aligned position, and therefore the depth of inhaling. Most importantly, frequency variations (breathing rate) are independent of duration variations (breathing depth), making it possible to adjust one without adjusting the other.

Additional features include a vacuum valve system wherein: the first conduit is stationary; the second conduit is mounted on a rocker arm for translating the second conduit; a variable speed motor is provided for varying the frequency of translation of the second conduit between the aligned and displaced positions; and a cam assembly is mechanically coupled between the rocker arm and the motor, which cam assembly is adjustable for varying the duration of fluid communication.

The present vacuum valve system was specifically designed for use with a flexible pressure vessel such as a respirator breathing jacket which fits around the torso of a human being and a vacuum generating assembly for creating a negative pressure within the jacket, to assist the user in breathing. However, the system can be used in other environments which require variable control of a pressure differential.

In addition to the ability to control the breathing rate independently of the depth of each breath, the present invention has several other advantages. It is inexpensive and can be fabricated using off-the-shelf items of manufacture. The valve interfacing connection between the conduits does not require close tolerances, so the invention in most of its parts does not require precision fabrication. The valve system is specifically designed for coupling to commonly available household vacuum cleaners, which are simple, inexpensive and present in most households. The system can be operated by relatively unskilled personnel.

DETAILED DESCRIPTION OF A PREFERRED EMBODIMENT

Figure 1:
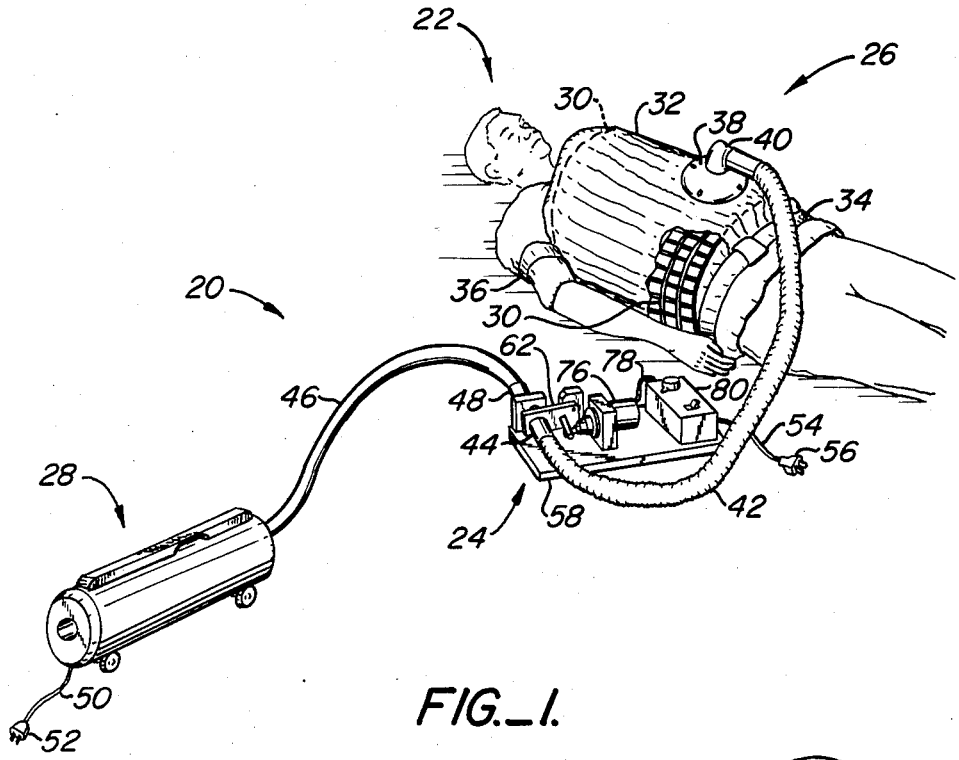
FIG. 1 is a schematic showing the inventive valve assembly connected between a respiratory jacket assembly and a vacuum generating assembly according to one embodiment of the invention.

Described below and shown in the drawing is a specific embodiment of that which the inventor considers at present to be the best mode of fabrication, assembly and operation for carrying out the invention. This is a necessarily narrow particular example of one of many possible ways to practice the claimed invention which is much broader in scope. The invention is actually defined by the appended claims.

System Overview

Figure 2:
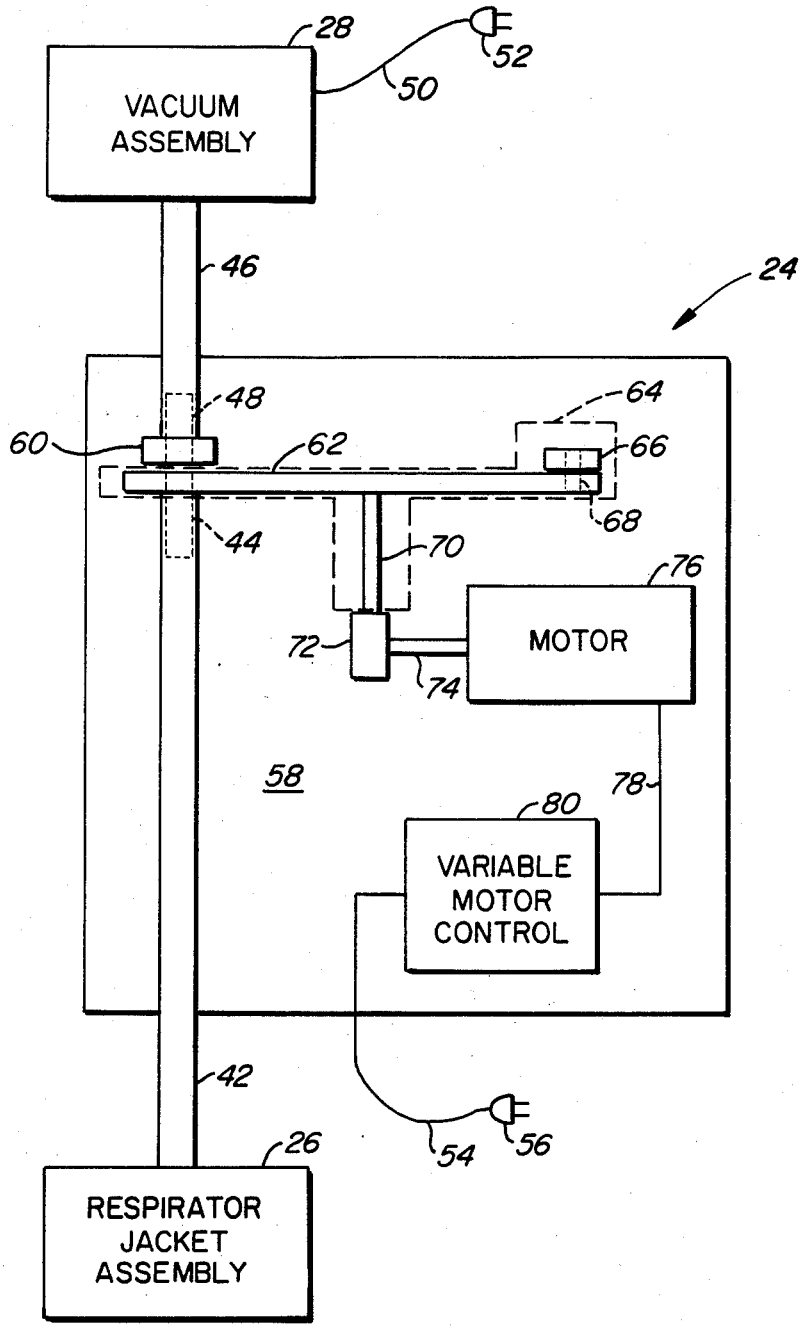
FIG. 2 is a block schematic diagram which emphasizes the inventive valve assembly in use in a typical environment.

FIGS. 1 and 2 respectively show the environment in which the inventive valve assembly was designed for use, and a partial schematic drawing of the valve assembly alone.

The purpose of the assembly shown as a pumping system 20 is to assist a user 22 in breathing. Pumping system 20 includes an inventive valve assembly 24, which is pneumatically coupled between a patient adaptor such as a respirator jacket assembly 26 and a vacuum generating assembly 28.

The construction of a typical respirator jacket assembly 26 includes a screen-like grid 30, curved to fit over the torso of user 22 in relative spaced apart relation to the torso. An airtight poncho-like jacket 32 is positioned over grid 30; jacket 32 extends below the waist and above the shoulder of user 22. With a waist belt 34 and a pair of arm cuffs 36, jacket 32 is secured to be substantially airtight around user 22. A plate 38 is screwed onto jacket 32 to provide an opening for inserting a pneumatic coupling 40.

Vacuum generating assembly 28 is a pump used as a source of vacuum pressure. A commonly available household vacuum cleaner functions well in this capacity.

To provide breathing assistance, jacket 26 must be joined to vacuum 28. Vacuum generator 28 can be joined by hose 46 to a first and preferably fixed conduit 48. A tube 42 pneumatically joins coupling 40 to a second and preferably movable conduit 44 provided on valve assembly 24. Conduits 44 and 48 preferaly have substantially identical cross-sectional areas. When coaxially aligned, conduits 44, 48 provide a path for fluid (e.g., air) flow from jacket 32 to vacuum assembly 28. Conversely, when movable conduit 44 is translated away from coaxial alignment with fixed conduit 48, the fluid flow path is interrupted. Moreover, conduit 44 is translated to a position at which it is exposed to ambient pressure. Thus, the vacuum created with jacket 32 by vacuum generating assembly 28 is broken, and air passes in through conduits 44 and 42 to jacket 32.

Vacuum generating assembly 28 is conventionally coupled through electrical wires 50 and plug 52 to a source of power. Likewise, valve assembly 24 is coupled to a power source through electrical wire 54 and plug 56. Vacuum assembly 28 is turned on to provide a constant source of negative pressure. Then, valve assembly 24 is energized, causing movable conduit 44 to oscillate between an aligned position, at which vacuum is communicated to jacket 32 to cause the user to inhale, and a displaced position, at which the vacuum is broken and ambient air pressure is communicated to the jacket to cause the user to ex-hale. Pumping system 20, therefore, is used to create a breathing rate and breathing duration for user 22.

Detail: Valve Assembly

Figure 3A:
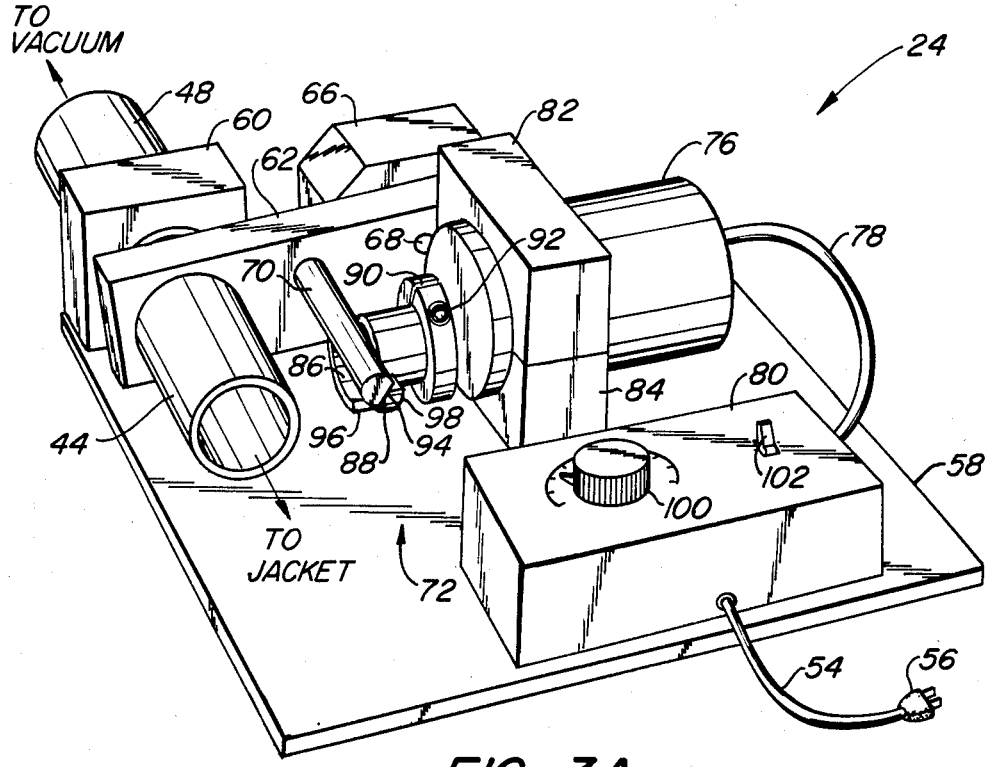
FIG. 3A is a top prespective view of the valve apparatus with the conduits in the aligned position (i.e., inhalation) phase.

FIG. 3A shows valve assembly 24 in the aligned position to form a vacuum seal between conduits 44 and 48. For visual clarity, second conduit 44 is shown positioned slightly below being coaxially aligned with first conduit 48.

Figure 3B:
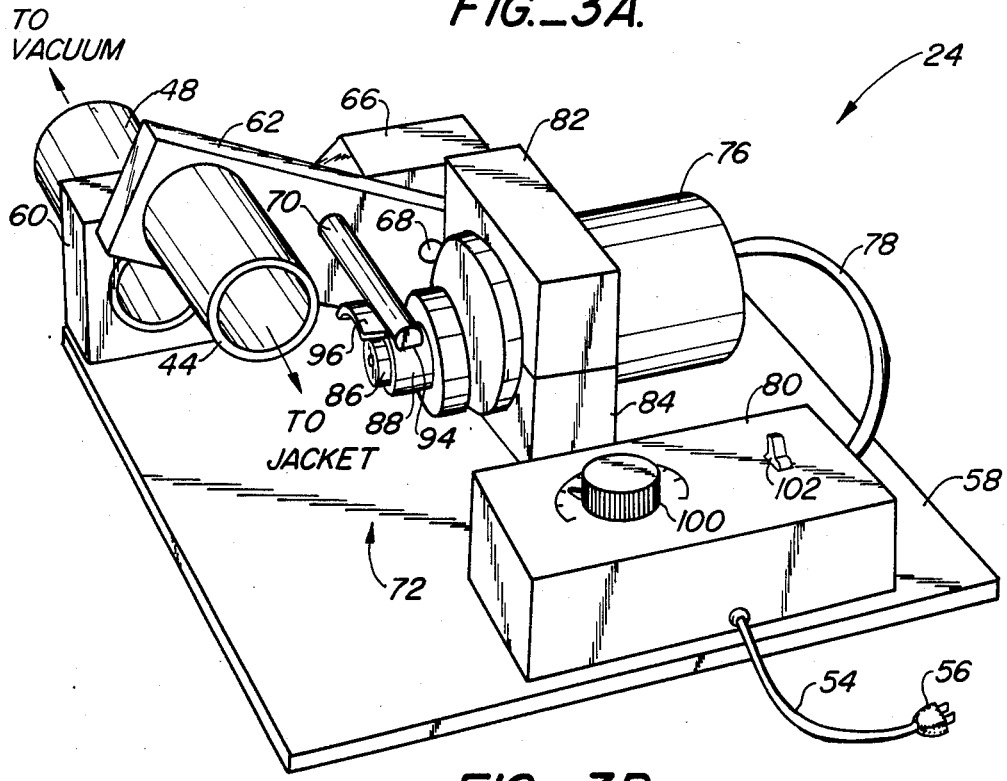
FIG. 3B is a top perspective view of the valve apparatus with the conduits in the displaced position (i.e., exhalation)

FIG. 3B shows valve assembly 24 in the displaced position, wherein movable conduit 44 is moved away from coaxial alignment with fixed conduit 48, to thereby break the vacuum seal between the conduits and permit air to enter into conduit 44.

The purpose of valve assembly 24 is to translate movable conduit 44 (1) into axial alignment with fixed conduit 48 to form a vacuum seal, and (2) away from axial alignment with conduit 48 to break the vacuum seal. Valve assembly 24 is adjustable to establish breathing frequency, that is, the number of breaths taken per minute, and breathing duration, that is, the length of time the user inhales during each breath (the depth or shallowness of breathing). In effect, valve assembly 24 "breathes" for user 22, at least during the inhaling cycle.

As will be understood, it will be equally possible to move first conduit 48 and have second conduit 44 be stationary. Alternatively, both conduits could be translated to make and break the vacuum in jacket 32.

Breathing frequency is set by the rate at which conduits 44 and 48 move in and out of coaxial alignment. Fixed conduit 48 is attached to a fixed mount 60 secured to base 58. Movable conduit 44 is mounted to a rocker arm 62 of a rocker assembly 64, and positioned on rocker arm 62 so that at least part of the time conduits 44 and 48 can be coaxially aligned. Rocker assembly 64 includes a rocker mount 66 to which rocker arm 62 is pivotally coupled through a rocker pin 68. A lifter 70 is positioned between movable conduit 44 and pin 68 to extend vertically away from rocker arm 62 and mechanically engage a cam assembly 72.

Breathing duration is set by cam assembly 72. Cam assembly 72 has an outside 86 and an inside cam 88, more fully described below, each cam having an arcuate surface of fixed length. These two arcuate surfaces preferably have the same radius of curvature, and are spaced apart to be circumferentially overlapping in a staggered fashion, and the two arcuate surfaces can be cooperatively adjusted to define a combined third arcuate surface.

For rotation, cam assembly 72 is coupled through a rotatable drive shaft 74 of a motor 76, which is electrically connected in a conventional manner through electrical wires 78 to a variable motor control 80. A pair of blocks 82 and 84 receive and secure motor 76, to base 58.

In order to secure cam assembly 72 to motor drive shaft 74, a slit 90 extends radially from the circumference to the center of inside cam 88. A screw 92 transversely extends across slit 90, and is tightened to elastically deform and secure cam assembly 72 on shaft 74 (see FIG. 2). Cam assembly 72 is described in further detail below in the discussion regarding FIG. 4.

The underside of lifter or arm 70 preferably is provided with a flat edge 94 which is positioned to slidingly ride across an arcuate surface 96 of outside cam 86 and arcuate surface 98 of inside cam 88.

Control 80 has a rheostat 100, adjustable for varying the operating speed of motor 76 and therefore frequency of translation of rocker arm 62 and movable conduit 54. A switch 102 is provided for turning power to motor 76 on and off.

An important advantage of rocker arm assembly 64 is that it provides a very positive way of making and breaking vacuum in jacket 32 without the need for precisely machined parts and close tolerances. As conduits 44 and 48 move toward the aligned position, the vacuum tends to draw movable conduit 44 toward block 60 to minimize leakage. Moreover, leakage can usually be tolerated because vacuum generating means 28 will generate more than sufficient vaccum to cause user inhalation.

Detail: Cam Assembly

Figure 4:
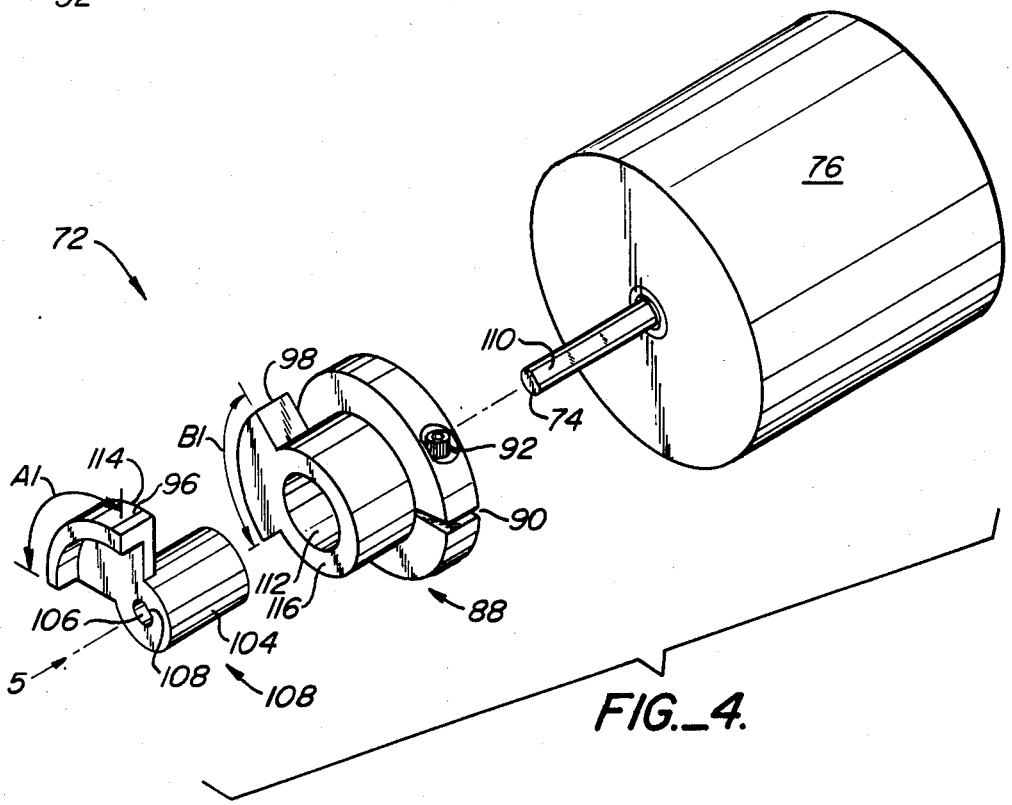
FIG. 4 is a top perspective, exploded view of the cam assembly and motor.

FIG. 4 is an exploded view of cam assembly 72 showing enlarged details which are partially visible in the above described FIGS. 3A and 3B.

Additional fabrication details not described above regarding outside cam 86 include a cylindrical neck 104 from which radially extends the arcuate surface 96, the arc length of which is indicated by an "A1" on the drawing. Neck 104 includes a bore 106 sized to slip onto shaft 74, and bore 106 is provided with a flat locking surface 108 for sliding over a matching flat surface 110 provided along a portion of shaft 74.

Inside cam 88 includes a hollow bore 112 having a diameter slightly larger than the diameter of neck 104 to enable receipt of neck 104 therein. Radially extending from bore 112 is an arcuate surface 98 having a constant arc length indicated at a line "B1".

To assemble cam assembly 72 and mount it on motor 76, neck 104 of outside cam 86 is slipped into bore 112 until a rearwardly facing edge 114 of outside cam 86 contacts a forward edge 116 of inside cam 88. Shaft 74 is slid into hole 106. Screw 92 is tightened, to pull the opposing faces of cam 86 within slit 90 together, thereby clamping cams 86 and 88 securely around shaft 74.

Figure 5A:
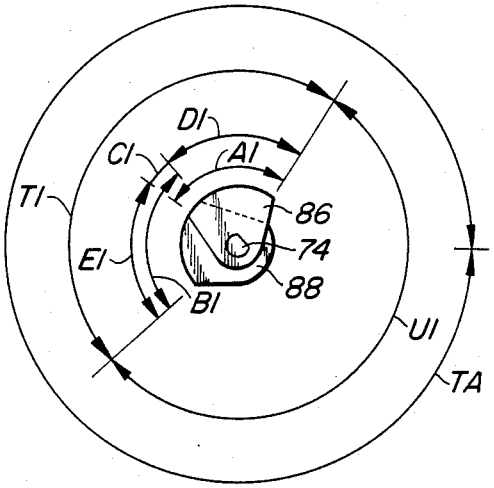
FIGS. 5A–5F show various end views and corresponding to perspective views of the cam assembly with the outside and inside cams in various circumferentially overlapping configurations.
Figure 5B:
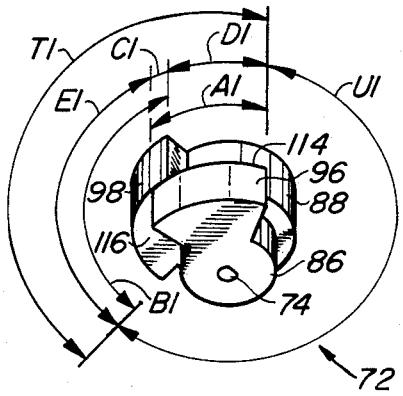
Figure 5C:
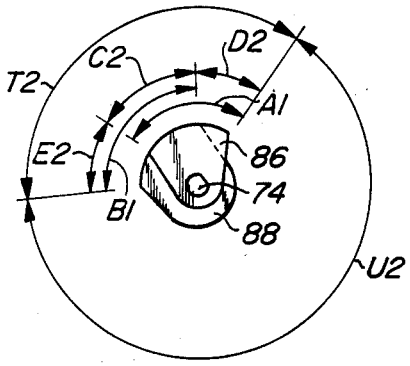
Figure 5D:
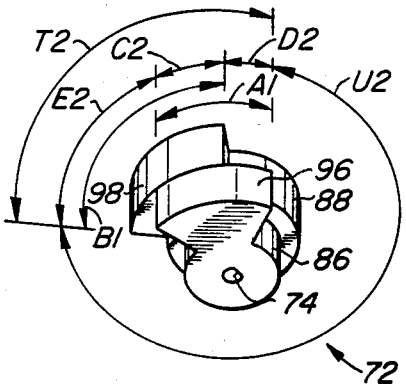

FIGS. 5A and 5B show two different views of cam assembly 72, with outside cam 86 and inside cam 88 circumferentially overlapped and axially spaced apart. This provides a relatively large arc bearing surface which is comprised of the sum of the nonoverlaping portions of arc surfaces 96 and 98 plus the overlapped portion.

The arc length of overlap between surfaces 96 and 98 is indicated as an arc C1. Therefore, nonoverlapped arc length D1 (which is A1 minus C1) plus nonoverlapped portion of arcuate surface 98 indicated as E1 (which is B1 minus C1) plus common or overlapped portion C1 can carry lifter 70. The total bearing arcuate surface is shown as arc length T1. The unsupported portion is indicated as an arc U1, which is the arc length other than that covered by T1.

FIGS. 5C–5F show how cams 86 and 88 can be rotated with respect to each other to change the amount of staggered overlap between arcuate surfaces 96 and 98, shown respectively as an arc length C2 (which is larger than arc length C1), and an arc length C3 (which is larger than arc length C2). As the amount of overlap is increased (goes from C1 to C2 to C3), the total amount of bearing surface, indicated respectively as the T1, T2 and T3 arc lengths, decreases. This means that rocker 70 will be held aloft for a shorter period of time, and conversely will be unsupported for a larger portion of time (see FIG. 3A). The longer cam assembly 72 does not support lifter 70, then the longer movable conduit 44 will be coaxial with fixed conduit 48. Because this is the aligned position, the effect is that user 22 will experience an inhaling duration which is relatively long. User 22 will therefore take a deeper breath.

Figure 5E:
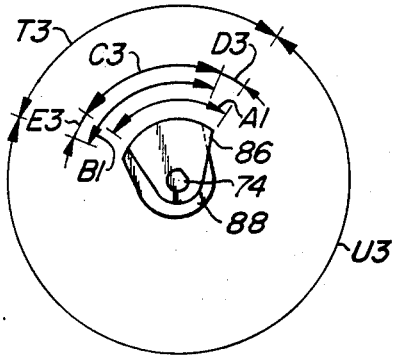
Figure 5F:
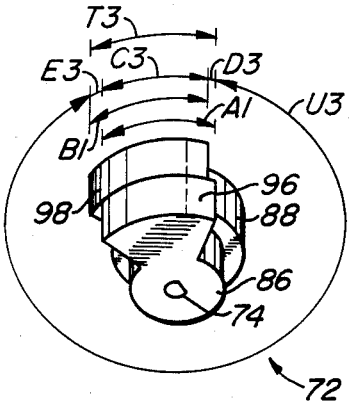

Conversely, if cams 86, 88 are aligned as shown in FIGS. 5A and 5B, the total combined supporting arcuate surfaces T1 is long. This means lifter 70 and therefore movable conduit 44 will be held aloft for a longer period of time than if cams 86 and 88 were configured as shown in FIGS. 5E and 5F. Likewise, lifter 70 will spend less time in the aligned position of FIG. 3A, resulting in user 22 taking shorter duration breaths and therefore breaths which are more shallow. Adjusting cams 86 and 88, therefore, adjusts the duration of breathing to set breathing depth.

Detail: Operation

First, inside and outside cams of cam assembly 72 are adjusted to set the duration of fluid communication between conduits 44 and 48. This sets the length of time during each frequency cycle that vacuum assembly 28 causes jacket 26 to breathe.

Next, vacuum assembly 28 is turned on to create a vacuum within hose 46 and fixed conduit 48. Then, control 80 is turned on and adjusted to vary the speed of motor 76, and therefore the cycling or frequency of how often conduits 44 and 48 will be coaxially aligned per unit of time.

As motor 76 rotates shaft 74 and cam assembly 72, lifter 70 will rotate rocker arm 62 about pin 68, causing movable conduit 44 to oscillate up an down with respect to base 58. In the position of FIG. 3A movable conduit 44 will be coaxial with fixed conduit 48, to create the aligned mode during which jacket assembly 26 is in fluid communication with vacuum assembly 28. A negative pressure is created around the torso of user 22, thus causing air to rush into the lungs of user 22 for inhalation.

Movable conduit 44, when in the top "up" or displaced position of FIG. 3B breaks the vacuum seal between conduits 44 and 48. This causes the negative pressure within jacket 26 to be equalized to a neutral pressure as air rushes in through displaced conduit 44, thereby permitting or causing user 22 to exhale.

The breathing apparatus of the present invention is formed in a manner which will allow either of the frequency or the duration of inspiration and expiration to be independently varied. Thus, one can set the frequency or breathing rate by adjusting rheostat 100. Such adjustments do not affect the ratio during each breathing cycle of inhalation and exhalation. Conversely, cam assembly 72 can be adjusted to change the ratio of inspiration to expiration without affecting the breathing rate. Unlike prior art devices, therefore, relatively unskilled personnel can easily and immediately make adjustments to the apparatus of the present invention to achieve a wide variety of operating conditions.

While the above description provides a full and complete disclosure of a specific embodiment of the invention, it is noted that various modifications, alternate constructions and equivalents can be employed without departing from the true spirit and scope of the invention. Therefore, the above description and interrelated drawings shall not be construed as limiting the invention the scope of which is defined by the breadth of the appended claims.

What is claimed is:

1. In a respirator assembly or the like includng a pressure source, valve means coupled to said pressure source, a patient adaptor coupled to said valve means, said valve means being movable between a position communicating a pressure from said pressure source to said patient adaptor and a position communicating a different pressure to said patient adaptor, and valve drive means coupled to said valve for movement thereof between the positions in a repetitive cycle, said valve drive means being independently variable as to the total cycle time of said valve means and the duration of said valve means in each of said positions, the improvement comprising:

said valve means including a base, a first conduit mounted to said base and having one end connected to one of said pressure source and said patient adaptor and having an opposite end, an arm, a second conduit carried by said arm and having one end connected to a remainder of said pressure source and said patient adaptor and having an opposite end, mounting means mounting said arm to said base for movement between an aligned position wherein the opposite end of said second conduit is substantially aligned with the opposite end of said first conduit for the communication of said pressure from said pressure source through said valve means to said patient adaptor and a non-aligned position wherein the opposite ends are not aligned with each other to permit communication of said different pressure through one of the opposite ends to said patient adaptor, said mounting means mounting the arm for movement of the second conduit to and from said aligned position with the opposite ends of the two conduits being proximate but in unsealed relation during said movmeent; and said valve drive means including a drive surface on said arm at a spaced distance from said mounting means, and a powered cam assembly engaging said drive surface and formed to move said arm through said drive surface.

2. The respirator assembly as defined in claim 1 wherein, said mounting means mounts said arm for pivotal movement and for gravity biasing toward one of said aligned and non-aligned positions; and said powered cam assembly is positioned to lift said arm through said drive surface against gravity.

3. The respirator assembly as defined in claim 1 wherein, said pressure source is a negative pressure source;

said arm is provided as a rocker arm pivotally mounted to said base for movement of a movable one of the opposite ends of said two conduits to non-aligned position at which atmospheric pressure is communicated to said patient adaptor through one of the opposite ends; and said patient adaptor is a support frame and airtight jacket dimensioned to be positioned over the torso of a patient.

4. The respirator assembly as defined in claim 3 wherein, said negative pressure source is provided by a vacuum cleaner;

said drive surface is provided by a lifter arm extending transversely of said rocker arm and formed to be engaged by said cam assembly.

* * * * *